US008769717B2

(12) United States Patent
Holland

(10) Patent No.: US 8,769,717 B2
(45) Date of Patent: Jul. 8, 2014

(54) COLLAPSIBLE SWIMSUIT

(75) Inventor: David C. Holland, Houston, TX (US)

(73) Assignee: David C. Holland, Houston, TX (US)

( * ) Notice: Subject to any disclaimer, the term of this patent is extended or adjusted under 35 U.S.C. 154(b) by 1728 days.

(21) Appl. No.: 11/977,271

(22) Filed: Oct. 24, 2007

(65) Prior Publication Data

US 2008/0040830 A1 Feb. 21, 2008

Related U.S. Application Data

(63) Continuation-in-part of application No. 10/603,899, filed on Jun. 25, 2003, now abandoned, which is a continuation-in-part of application No. 10/185,230, filed on Jun. 28, 2002, now abandoned.

(51) Int. Cl.
*A41D 7/00* (2006.01)

(52) U.S. Cl.
USPC ..... 2/67

(58) Field of Classification Search
USPC ..... 2/67, 71, 72, 113, 115
See application file for complete search history.

(56) References Cited

U.S. PATENT DOCUMENTS

| | | | | |
|---|---|---|---|---|
| 2,018,782 | A | 10/1935 | Gephart | 2/224 |
| 2,085,425 | A | 6/1937 | Goodwin | 2/224 |
| 2,206,412 | A | 7/1940 | Levy | 2/46 |
| 2,272,830 | A | 2/1942 | Brody et al. | 2/224 |
| 2,335,658 | A | 11/1943 | Fishbein | 2/67 |
| 2,355,404 | A | 8/1944 | Virden et al. | 2/67 |
| 2,401,457 | A | 6/1946 | Bryant | 2/224 |
| 2,419,867 | A | 4/1947 | Woodman | 2/224 |
| 2,544,840 | A | 3/1951 | Kowatsch | 2/67 |
| 2,622,600 | A | 12/1952 | De Guyot et al. | 128/288 |
| 3,456,457 | A | 7/1969 | Cass | 63/2 |
| 3,774,241 | A | 11/1973 | Zerkle | 2/67 |
| 3,847,158 | A | 11/1974 | Guidoni | 128/492 |
| 3,939,845 | A | 2/1976 | Guidoni | 128/492 |
| 4,028,740 | A | 6/1977 | Luerken | 2/67 |
| 4,031,900 | A | 6/1977 | Guidoni | 128/493 |
| 4,121,305 | A | 10/1978 | Kolker | 2/406 |
| 4,145,762 | A | 3/1979 | Wallach | 2/67 |
| 4,404,689 | A | 9/1983 | DeWan | 2/247 |
| 4,459,703 | A | 7/1984 | Kosmas et al. | 2/48 |
| D278,473 | S | 4/1985 | Briggery Myles | D2/40 |
| 4,635,640 | A | 1/1987 | Sehorn | 128/438 |
| 4,656,669 | A | 4/1987 | Beard | 2/67 |
| 4,674,135 | A | 6/1987 | Greene | 2/400 |
| 4,815,145 | A | 3/1989 | Chow | 2/67 |
| 5,031,248 | A | 7/1991 | Kemper | 2/406 |
| 5,067,178 | A | 11/1991 | Katchka | 2/250 |
| 5,093,935 | A | 3/1992 | Countee, Jr. | 2/400 |
| 5,172,430 | A | 12/1992 | Lerma-Solis | 2/400 |
| 5,459,875 | A | 10/1995 | Fattorusso et al. | 2/67 |
| 5,483,701 | A | 1/1996 | Ferreyros | 2/49.2 |
| 5,551,093 | A | 9/1996 | Stricker | 2/406 |
| 5,561,858 | A | 10/1996 | Poirier | 2/67 |
| 5,561,865 | A | 10/1996 | Fjelstul | 2/227 |
| 5,564,125 | A | 10/1996 | Waldman et al. | 2/93 |
| 5,584,077 | A | 12/1996 | Thrift | 2/239 |

(Continued)

*Primary Examiner* — Alissa L Hoey
(74) *Attorney, Agent, or Firm* — Mossman, Kumar & Tyler PC

(57) ABSTRACT

A collapsible swimsuit includes a loop for supporting the suit on the human body. The swimsuit also includes a pair of fastening devices which, when disengaged, make it possible to fold the body of the swimsuit and store it compactly into a pouch on the swimsuit.

2 Claims, 5 Drawing Sheets

(56) References Cited

U.S. PATENT DOCUMENTS

| | | | | |
|---|---|---|---|---|
| 5,664,257 | A | 9/1997 | Hall | 2/69 |
| D384,487 | S | 10/1997 | Ingels | D2/716 |
| 5,983,393 | A | 11/1999 | Walton | 2/69 |
| 5,991,920 | A | 11/1999 | Holland | 2/67 |
| 6,009,556 | A | 1/2000 | Nenninger | 2/67 |
| 6,016,569 | A | 1/2000 | Everett et al. | 2/67 |
| 6,018,823 | A | 2/2000 | Ortmeier | 2/406 |
| 6,067,663 | A | 5/2000 | Fernandez | 2/406 |
| 6,086,451 | A | 7/2000 | Fernandes | 450/86 |
| 6,185,741 | B1 | 2/2001 | Kehoe | 2/67 |
| 6,240,560 | B1 | 6/2001 | DeCaro | 2/67 |
| 6,247,184 | B1 | 6/2001 | Watts | 2/400 |
| 6,279,171 | B1 | 8/2001 | Brancato | 2/326 |
| 6,336,226 | B1 | 1/2002 | Garcia | 2/227 |
| 6,360,375 | B1 | 3/2002 | Hart | 2/406 |
| 6,374,412 | B1 | 4/2002 | Canlas | 2/67 |
| 6,435,392 | B1 | 8/2002 | Kennedy | 224/680 |
| 6,490,732 | B1 | 12/2002 | Spoke | 2/67 |
| 6,560,786 | B2 | 5/2003 | Lipton | 2/400 |
| D37,987 | S * | 1/2004 | Holland | 2/67 |
| 6,738,988 | B2 | 5/2004 | Ruiter et al. | 2/400 |
| 6,792,620 | B2 | 9/2004 | Green | 2/69 |
| 6,817,031 | B1 | 11/2004 | Gravlin | 2/67 |
| 6,817,038 | B2 * | 11/2004 | Blanco | 2/406 |
| 6,832,983 | B2 | 12/2004 | Goodman | 600/38 |
| 6,868,555 | B2 * | 3/2005 | Zic et al. | 2/67 |
| 6,872,119 | B2 | 3/2005 | Brink | 450/86 |
| 7,168,096 | B1 * | 1/2007 | Landa et al. | 2/67 |
| 2003/0196239 | A1 | 10/2003 | Zic et al. | 2/67 |
| 2003/0226197 | A1 | 12/2003 | Cramer | 2/466 |
| 2004/0034902 | A1 | 2/2004 | Yturria | 2/400 |
| 2004/0083537 | A1 | 5/2004 | Mosha et al. | 2/400 |
| 2005/0138716 | A1 | 6/2005 | Orsos | 2/67 |
| 2008/0184452 | A1 * | 8/2008 | Smaczny | 2/67 |
| 2009/0205100 | A1 * | 8/2009 | Flower et al. | 2/67 |

* cited by examiner

COLLAPSIBLE SWIMSUIT

CROSS REFERENCES TO RELATED APPLICATIONS

This application is a continuation-in-part of U.S. patent application Ser. No. 10/603,899, filed on 25 Jun. 2003, now abandoned which is a continuation-in-part of U.S. patent application Ser. No. 10/185,230 filed on 28 Jun. 2002, now abandoned.

FIELD OF THE INVENTION

This invention relates to a collapsible garment and a method for using the same. More particularly, the invention relates to a swimsuit that can be folded into its belt or a pouch attached to the belt without the necessity of taking the garment off and a method for manufacturing such a swimsuit.

BACKGROUND OF THE INVENTION

In recent years, there has been an increased interest in the "back to nature" movement and in enjoying life unencumbered by clothes. Most jurisdictions have regulations against public nudity and this acts as a restraint on those who would like to enjoy life in pretty much the state in which they were born. People will be people and those who would like to swim "in the raw", so to speak, have two choices if they wish to act unfettered: (a) wear no clothing, or, (b) wear a swimsuit on the beach and take it all off when at a safe distance from any Peeping Toms.

As noted above, option (a) is usually illegal and, in many instances, people are not disposed to so appear in public. There is also the problem of finding a deserted location at which to take off the swimsuit. Facilities for discrete donning and removal of clothing may not exist at beaches and swimming pools. Removing clothing also presents problems in cold and/or windy weather.

Option (b), while aesthetically more appealing to the public at large, presents dangers to the swimmer. Taking the swimsuit off under water requires either bending down or stepping out of the swimsuit and can be dangerous and has the problem of collecting sand and grit inside the swimsuit. There is the additional problem of holding on to the garment once it has been taken off: if both hands are not devoted to the task, there is the risk of losing the swimsuit and the swimmer is back to the situation presented in option (a). Prior art swimsuits also present problems in putting the swimsuit back on. There is difficulty in identifying the proper holes into which legs must go, particularly in active surf. Once back on, any accumulated sand and grit can be very uncomfortable.

U.S. Pat. No. 5,991,920 to Holland, the contents of which are fully incorporated herein by reference, teaches a swimsuit that includes a body and a belt, a portion of the body encircling a portion of the belt to form at least one pouch. The other end of the body has fastening devices that attach them to the belt opposite the pouch to form a conventional-looking swimsuit. Detaching the clips, folding up the body and inserting it into the pouch(es) gives a compact arrangement of a belt with a small pouch attached to it.

One embodiment of the invention of Holland is illustrated in FIG. 1 (Prior Art). As shown, the swimsuit 1 includes a belt 3 adapted to encircle a human waist. The belt defines an inside and an outside. The belt is preferably made of a fabric with some ability to stretch so as to maintain a snug fit with the waist of the person wearing the garment. The swimsuit also includes a body part 4, one end 4*a* of which defines a pair of pouches (storage compartments) 2 that enclose a portion of the belt. The sides of pouches are maintained in sliding contact with the portion of the belt that they encircle and are provided with openings purpose of which will be discussed below. As shown in FIG. 1, the pouches are separated by a seam 12 in the middle, the seam coupling the body part 4 to the belt 3. An alternated embodiment of the invention has a single pouch extending all the way across the back.

The invention of Holland, while being fully adapted for the function for which it was designed, was found to have some drawbacks. Drawbacks are purely aesthetic. When the swimsuit is fully folded into the pouch surrounding the belt may, it may have a bulky appearance. In addition, when the swimsuit is in the configuration for wear on the beach, it may be difficult to configure the top rear of the suit for a perfect fit.

There is a need for a swimsuit that enables the law abiding swimmer to comply with applicable rules and regulations. Such a swimsuit should allow the swimmer to enter the water discretely clothed. Such a swimsuit should preferably be safe and easy to disengage from the human body. Such a swimsuit should remain attached to the human body without the use of hands. Such a swimsuit should be easy to put back on. In addition, it should preferably be aesthetically appealing in both the engaged and disengaged positions. The swimsuit should also be easy to manufacture. The present invention satisfies this need.

SUMMARY OF THE INVENTION

One aspect of the present invention is a modification of a conventional swimsuit that has a pair of detachable fasteners. When the fasteners are decoupled, the portion of the swimsuit encircling human legs is "opened up" and may be rolled into a compact size that can be stowed inside a pouch on the swimsuit. Support for the swimsuit is provided by a loop that at least partially encircles a human waist.

Another aspect of the present invention is a method of using the novel swimsuit so as to appear covered up in the closed configuration of the swimsuit and to be able to open up the swimsuit while the swimsuit is supported by a loop around the human waist.

Yet another aspect of the present invention is a method of making a novel collapsible swimsuit by attaching a loop and a plurality of fastening devices to a prior art swimsuit that has been altered.

BRIEF DESCRIPTION OF THE DRAWINGS

The present invention is best understood with reference to the following figures wherein like numbers refer to like elements.

DETAILED DESCRIPTION OF THE INVENTION

Figure 1:
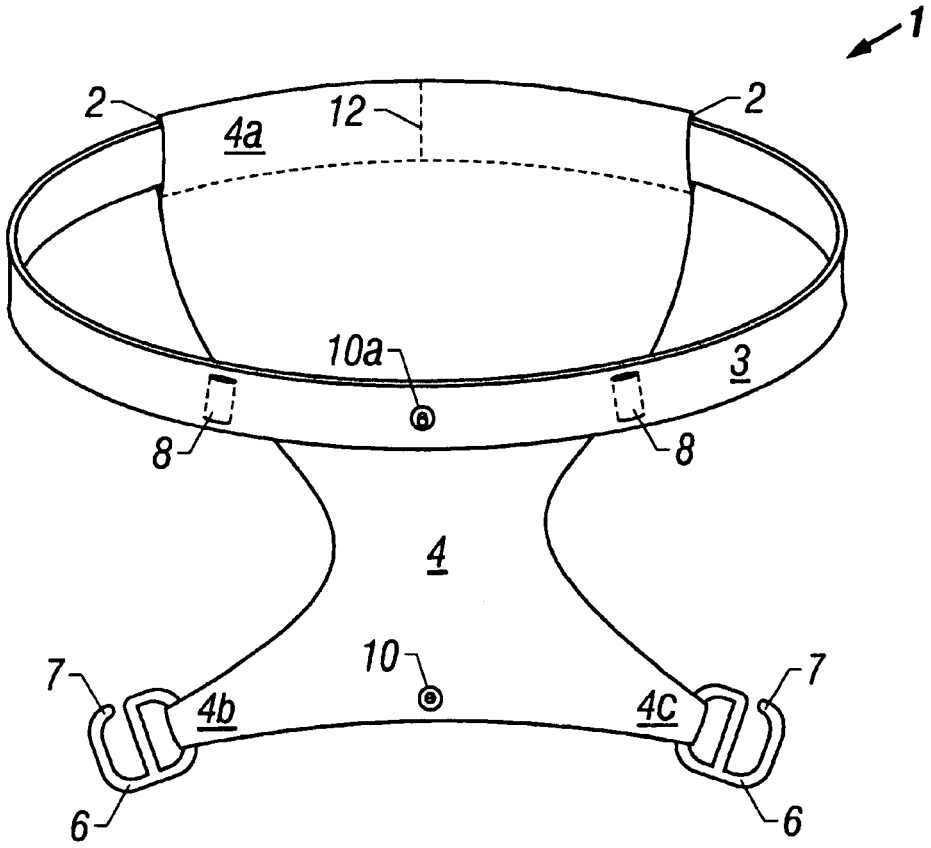
(PRIOR ART) FIG. 1
FIG. 1 (Prior Art) is a view of a prior art collapsible swimsuit.
Figure 2:
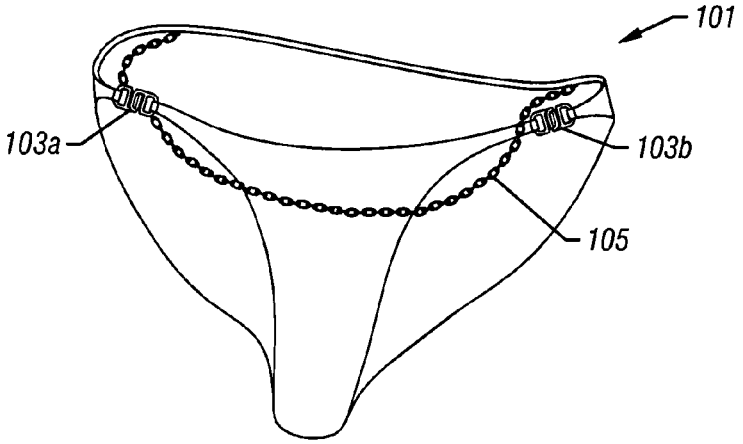
FIG. 2 illustrates a swimsuit according to the present invention.

The present invention is best understood with reference to FIGS. 2-5 that illustrate the arrangement of the various parts of the swimsuit. Referring to FIG. 2, a swimsuit 101 is shown. The swimsuit includes a loop 105 attached to the swimsuit to at least partially enclose a human waist: the exact manner in which it encircles the human waist is discussed below. The loop may be made of any suitable material but in a preferred embodiment of the invention as shown in FIG. 2 preferably comprises a decorative chain that is made of material resistant to corrosion by seawater. In an alternate embodiment of the invention, the loop comprises a tubular member such as a cord or "piping". Two fasteners 103*a*, 103*b* on the swimsuit 101 are shown in the engaged position so that the swimsuit appears at first sight to be a conventional swimsuit with a decorative loop. When configured as shown, the swimsuit body includes a first opening for a human waist, a second opening for a first leg and third opening for a second leg.

Figure 3:
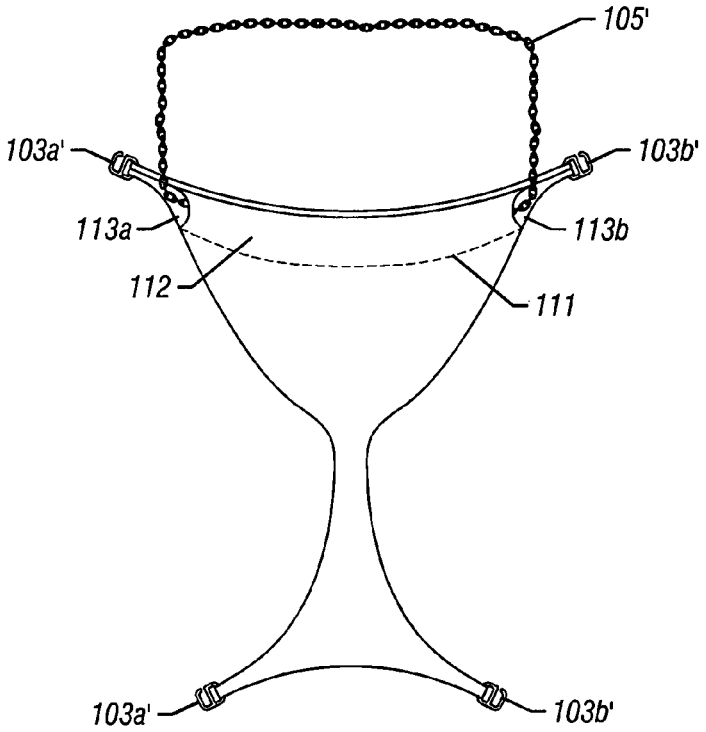
FIG. 3 illustrates the swimsuit according to the present invention in the detached configuration.
Figure 4:
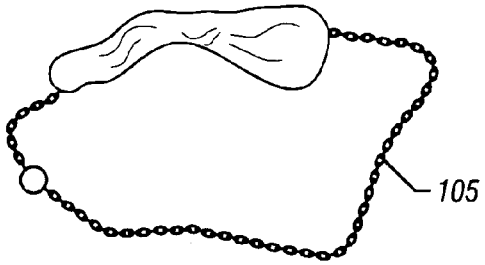
FIG. 4 illustrates the swimsuit according to the present invention in the collapsed configuration.

Turning now to FIG. 3, the swimsuit is shown in the disengaged configuration with the fastener 103*a* now showing its components 103*a*' disengaged into its components and fastener 103*b* disengaged into its components 103*b*'. In the configuration shown in FIG. 3, another feature of the swimsuit becomes apparent: the rear of the swimsuit is seen to have an additional piece of fabric 112 (with a seam 111) that defines a pouch between the member 112 and the rear of the swimsuit. The pouch as shown in FIG. 3 has two openings 113*a*, 113*b*. As can be seen in FIGS. 2 and 3, the fastening devices 103*a*' and 103*b*' couple parts of the body that are not on the loop 105'.

Also seen in FIG. 3, the loop member is preferably inserted into the pouch (storage compartment). In one embodiment of the invention, the loop member may pass completely through the pouch and thus be capable of fully encircling the human waist. In an alternate embodiment of the invention, the loop member may be fastened at two places (not shown) to the rear of the swimsuit and thus only partially encircle the human waist. Other configurations of the swimsuit may include two pouches as taught in Holland.

As taught in Holland, the body of the swimsuit may be rolled up and inserted for storage into the pouch or storage compartment. As discussed in Holland, this is accomplished by rolling up the portion of the swimsuit disengaged from the portion of the swimsuit proximate to the loop and inserting the rolled up portion into the pouch. This is shown in after rolling up and storing in the pouch in FIG. 4. Details of the method of rolling up and storing are discussed below with reference to FIGS. 7 and 8.

Figure 5:
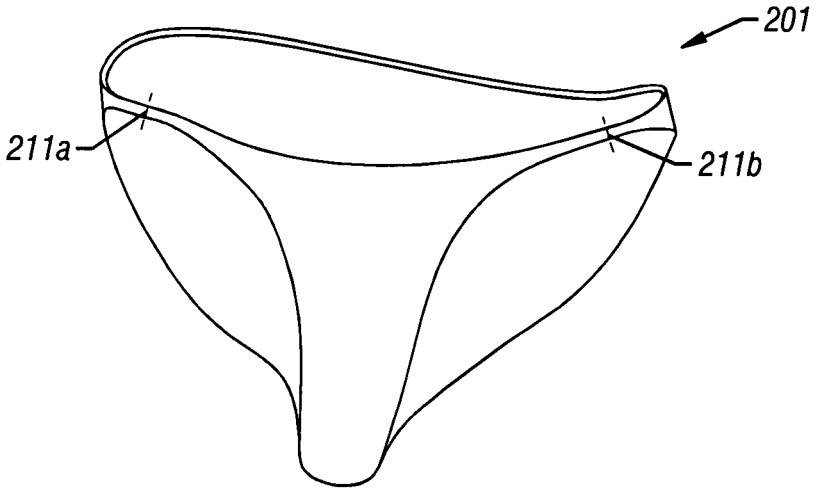
FIG. 5 illustrates a conventional swimsuit.
Figure 6:
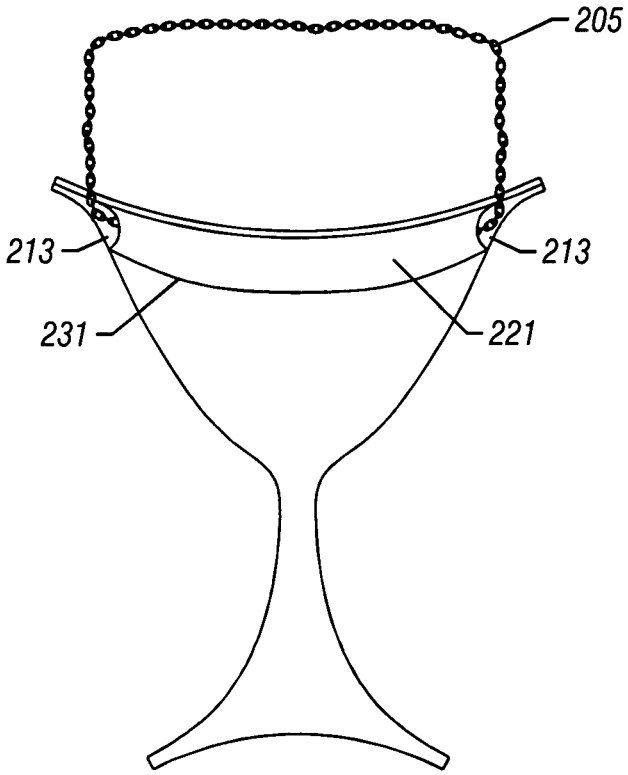
FIG. 6 illustrates a conventional swimsuit at an intermediate step in its modification to being collapsible.

Turning now to FIGS. 5 and 6, a method of making the swimsuit discussed above is shown. FIG. 5 shows a conventional swimsuit 201. By separating the swimsuit, e.g. by cutting, at locations indicated by 211*a*, 211*b*, the configuration shown in FIG. 6 results. Manufacture of the swimsuit of the present invention then requires the addition of a piece of fabric 221 to the swimsuit by a seam such as 231 to define a storage compartment with ends 213 shown, the addition of fastening devices at or near the locations of the separation points 211*a*, 211*b* of FIG. 5, and the incorporation of the loop 205 to give a result that would appear to be substantially the same as in FIG. 3. The advantages of this method of making the swimsuit would be clear since this modification could be done to "off the rack" items that are widely available.

Figure 7:
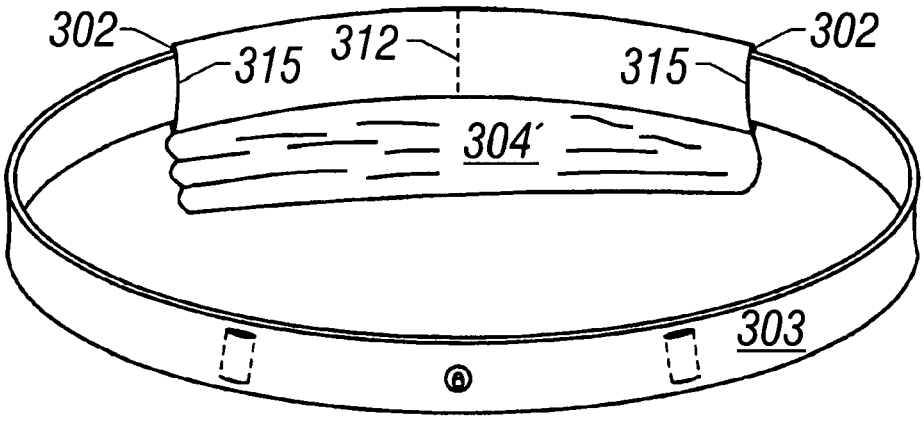
(PRIOR ART) FIG. 7
FIG. 7 (Prior Art) shows the garment of FIG. 1 with the body rolled or folded up.
Figure 8:
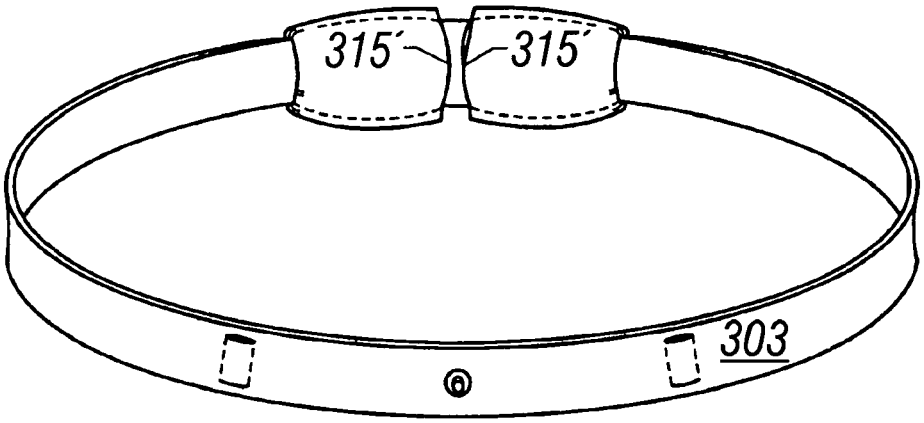
(PRIOR ART) FIG. 8
FIG. 8 (Prior Art) shows the garment of FIG. 1 with the body stowed into the storage compartment in the body.

The method in which the swimsuit is stored within itself is shown using the teachings of Holland as an example. FIG. 7 illustrates the invention of Holland when the fasteners are disengaged and the body is rolled up tightly to abut the pouches 302 encircling the belt 303. The body in the rolled up position is depicted by 304'. Also shown are the openings 315 in the pouches 302. Because the pouches of Holland are made of the same material as the body and are flexible, the rolled up body can be inserted into the openings and at the same time, the edges of the opening 315 folded back to the position 315' shown in FIG. 8. As shown in FIG. 8, the ends of the opening have been folded back from both sides. As can be seen in FIG. 8, when the clips are disengaged, the body rolled up, and the ends of the opening folded back, the entire garment collapses to a compact shape defined by the belt and the small enclosure around it. The same method is used in the present invention for rolling up and storing the swimsuit within itself using the openings 113*a*, 113*b*.

Figure 9:
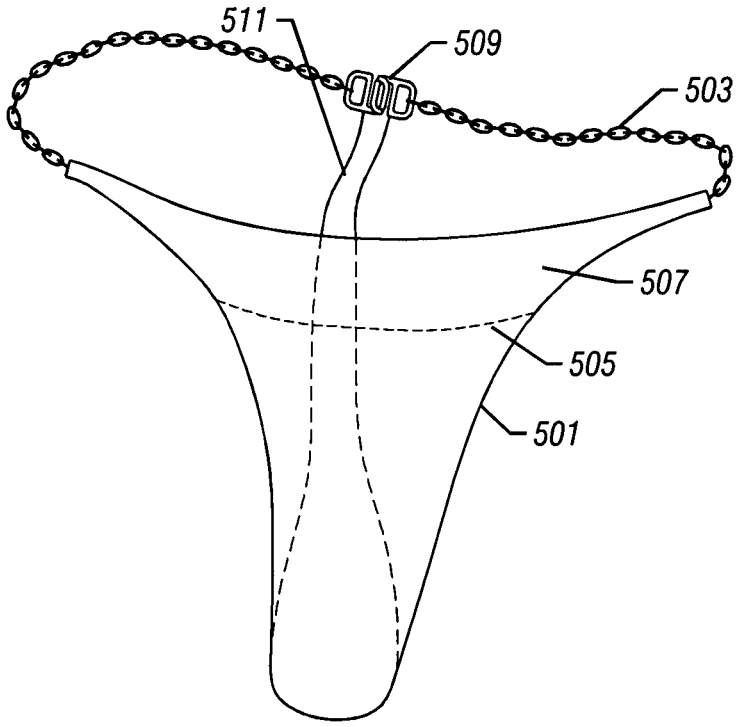
FIG. 9 shows an alternate embodiment of the swimsuit according to the present invention.

FIG. 9 is an illustration of an alternate embodiment of a swimsuit in what is commonly known as a "thong" swimsuit. Shown is a swimsuit 501 with a "thong" portion 511 extending to the back of the swimsuit, the front of the swimsuit having a width greater than the width of the thong at the back of the swimsuit. The swimsuit is provided with a pouch 507 defined by the seam 505 of a piece of fabric attached to the body of the swimsuit. To simplify the illustration, the openings of the pouch are not shown. A chain 503 (or piping or other tubular member) defines a loop that can encircle the human waist. Alternatively, element 503 may be an integral part of the body of the swimsuit. As with the embodiment discussed above, the chain or tubular member may circle the human waist partially or entirely. The end of the thong is provided with a fastener 509 for attaching to the chain 503. One important difference between this embodiment of the invention and the one discussed above (and in Holland) is that the pouch is now in the front rather than in the back. The method of folding and stowing remain the same.

EXAMPLES

The following example is provided to illustrate the present invention. The example is not intended to limit the scope of the present invention and it should not be so interpreted.

Example 1

Example 1 is a demonstration of the method of the invention. A video first shows a front view of a model wearing a body suit and a swimsuit, the swimsuit substantially corresponding to the drawing labeled as FIG. 2. Next, the model begins and completes the process of reconfiguring the swimsuit to the condition shown in FIG. 4. This is executed by first decoupling both fastening devices on the body of the swimsuit and separating a first part of the body of the swimsuit from a second part of the body of the swimsuit, the first and second parts not being on a loop; compacting the body of the swimsuit into a small space while keeping the loop around the waist; storing the compacted body of the swimsuit using at least one storage compartment on the body of the swimsuit; and using a loop at least partially encircling the human body for supporting the swimsuit on the human waist. In this embodiment of the invention, it can be seen that the storage compartment is, in fact, formed from the body of the swimsuit.

The foregoing description has been limited to specific embodiments of this invention. It will be apparent, however, that variations and modifications may be made to the disclosed embodiments, with the attainment of some or all of the advantages of the invention. Therefore, it is the object of the appended claims to cover all such variations and modifications as come within the scope of the invention.

The invention claimed is:

1. A swimsuit comprising:

(a) a loop configured to at least partially encircle a human waist, the loop comprises a chain made of a material resistant to corrosion;

(b) a body having a front end and a rear end, the front end having a width greater than the rear end;

(c) a single fastener configured to detachably couple the rear end of the body to said loop, there being no other fastener coupling the rear end of the body to said loop; and (d) a storage compartment on the front of the swimsuit configured to stow the body; wherein the loop is positioned relative to the swimsuit body so that when said fastener is attached, the swimsuit may be worn by a human, and, when worn, the swimsuit is configured to have a first opening for the human waist, a second opening for a first leg, and a third opening for a second leg.

2. The swimsuit of claim 1 wherein said loop is adapted to completely encircle said human waist.

* * * * *